US007621716B2

(12) United States Patent
Regunath

(10) Patent No.: US 7,621,716 B2
(45) Date of Patent: Nov. 24, 2009

(54) TURBINE CASE COOLING

(75) Inventor: Shane Regunath, Derby (GB)

(73) Assignee: Rolls-Royce, PLC, London (GB)

( * ) Notice: Subject to any disclaimer, the term of this patent is extended or adjusted under 35 U.S.C. 154(b) by 520 days.

(21) Appl. No.: 11/199,181

(22) Filed: Aug. 9, 2005

(65) Prior Publication Data

US 2006/0051197 A1 Mar. 9, 2006

(30) Foreign Application Priority Data

Sep. 4, 2004 (GB) ..... 0419652.3

(51) Int. Cl.
*F01D 11/24* (2006.01)

(52) U.S. Cl. ..... 415/1; 415/173.2; 701/100

(58) Field of Classification Search ..... None
See application file for complete search history.

(56) References Cited

U.S. PATENT DOCUMENTS

| | | | | |
|---|---|---|---|---|
| 4,849,895 | A | 7/1989 | Kervistin | |
| 4,999,991 | A | 3/1991 | Haddad et al. | |
| 5,012,420 | A * | 4/1991 | Walker et al. | 415/1 |
| 2001/0001845 | A1 * | 5/2001 | Khalid et al. | 701/100 |
| 2005/0149274 | A1 * | 7/2005 | Finnigan et al. | 702/33 |

* cited by examiner

*Primary Examiner*—Richard Edgar
(74) *Attorney, Agent, or Firm*—Oliff & Berridge, PLC

(57) ABSTRACT

A method of controlling turbine case cooling in a gas turbine engine, the method including monitoring the present state of the engine 32 and using a predictive model based system 44, 46 to predict the future thermal expansion of the turbine case 12 and turbine blades 28, and controlling cooling of the turbine case 12 in response to said prediction to provide a required gap 30 over time.

8 Claims, 2 Drawing Sheets

TURBINE CASE COOLING

This invention concerns a method of controlling turbine case cooling in a gas turbine engine, and also a turbine case cooling arrangement for a gas turbine engine.

Turbine case cooling is often used in gas turbine engines, and particularly in larger gas turbine engines used on aircraft. This cooling is provided to try and maintain a required small gap between the outer tips of the turbine blade and the inner skin of the turbine case. As the core engine temperature rises, the inner skin will generally expand at a faster rate than the turbine blade, which tends to increase the size of this gap and hence reduce engine efficiency.

Accordingly, turbine case cooling is often provided to force cool air between the outer and inner skins of the turbine casing to reduce expansion of the inner skin. Presently such cooling is carried out without any feedback as to the precise situation at any time, and thus the amount of cooling used requires to be conservative to avoid the risk of the turbine blade rubbing against the casing.

To provide sensors to measure this gap in use is very difficult, and particularly in view of the harsh working environment bearing in mind that the turbines are immediately downstream of the engine combustor. To date practical sensors which can provide operation over time in such conditions are not available. Using sensors would also have the disadvantages of extra weight and complexity in use, as well as extra operations during the build sequence.

According to the present invention there is provided a method of controlling turbine case cooling in a gas turbine engine, the method including monitoring the present running state of the engine and predicting with a model based system the future thermal expansion of the turbine case and turbine blades, and controlling cooling of the turbine case in response to said prediction to provide a required gap between the turbine case and the turbine blades over time.

The model based system preferably includes the turbine case and turbine blade expansion rates.

The engine monitoring may be carried out by measuring the turbine gas temperature, and particularly the temperature of gases exiting the low pressure turbine.

Alternatively, the engine monitoring may be carried out by any of: measuring the gas temperature in the engine other than in the turbine; measuring fuel flow in the engine; measuring the engine spool speed; or measuring the air pressure being delivered to the combustor.

The cooling of the turbine case is preferably provided by supplying cool air between the inner and outer skins of the turbine case, and the amount of air supplied may be variable.

The invention also provides a turbine case cooling arrangement for a gas turbine engine, the arrangement including a model based predictive controller which controls cooling of the turbine case using a method according to any of the preceding five paragraphs.

An embodiment of the present invention will now be described by way of example only and with reference to the accompanying drawings, in which:—

Figure 1:
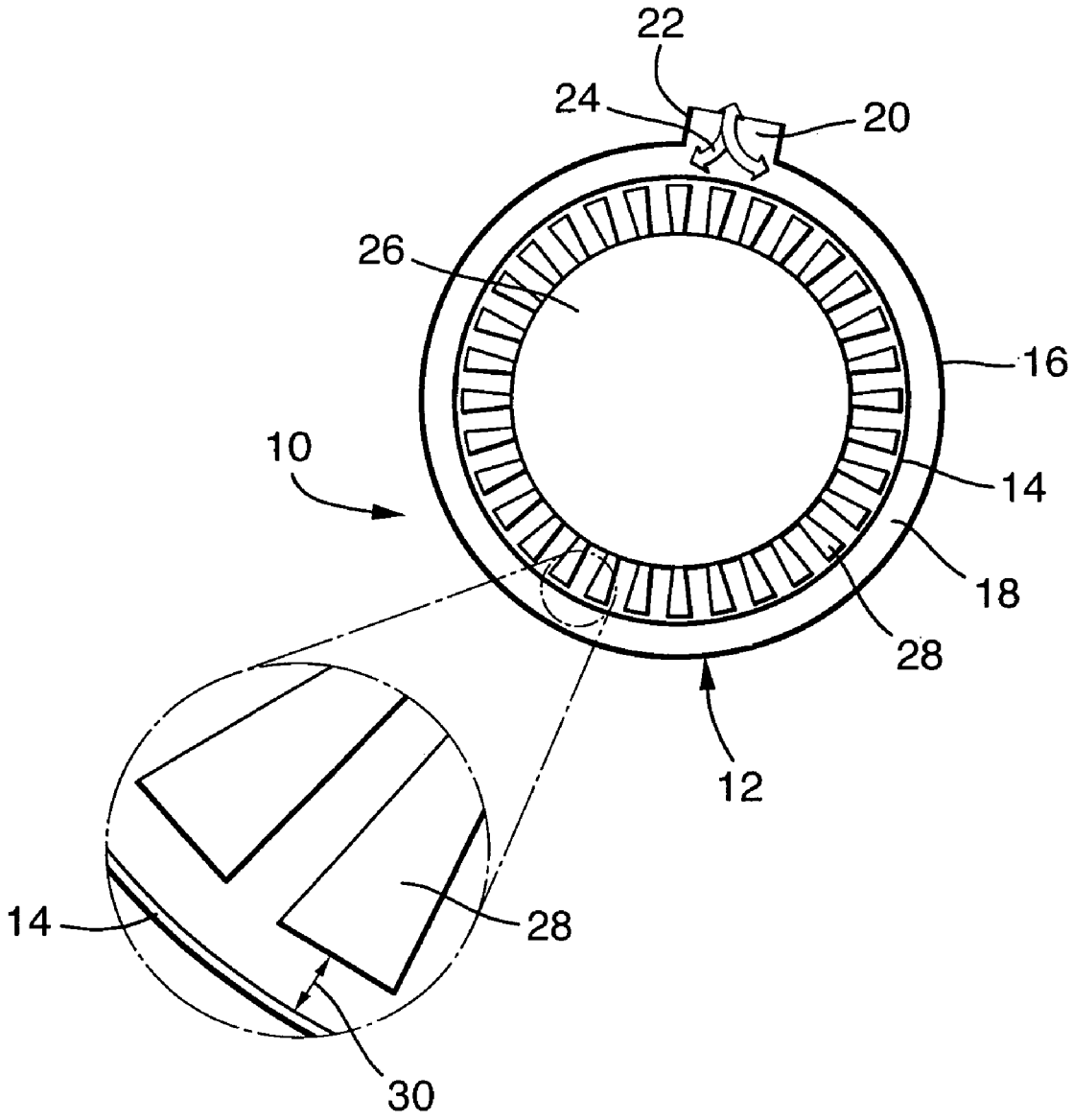
FIG. 1 is a diagrammatic rear view of a turbine of a gas turbine engine.

FIG. 1 shows a turbine 10 including a case 12 having inner and outer skins 14, 16 defining a cooling space 18 therebetween. An opening 20 is provided leading into the cooling space 18, with a valve 22 controlling input of air into the cooling space 18. Air entering the cooling space 18 is shown by the arrows 24. The turbine 10 also includes a turbine disc 26 mounting a plurality of turbine blades 28. The enlarged part of FIG. 1 shows the gap 30 between the blades 28 and the inner skin 14.

In operation it is generally desirable to maintain the gap 30 at a constant minimum level to provide efficient operation of the engine, whilst avoiding any rubbing of the blades 28 against the inner skin 14.

Figure 2:
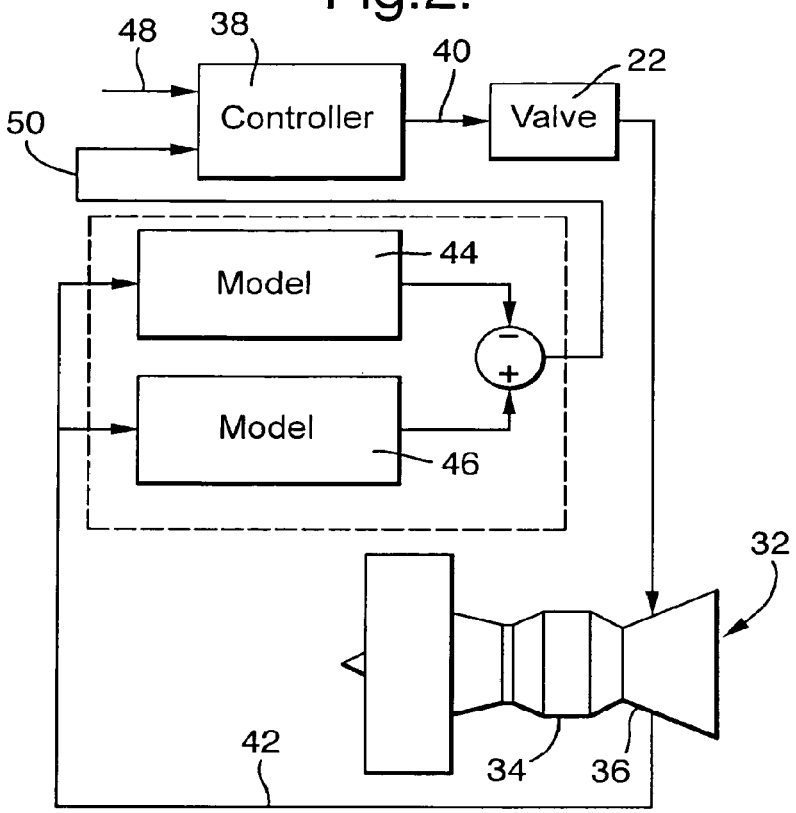
FIG. 2 is a schematic diagram of a turbine case cooling arrangement according to the invention.

FIG. 2 illustrates a turbine case cooling system according to the invention, for controlling the gap 30. In considering FIG. 2, an aero gas turbine engine 32 is shown which will have a combustor shown generally at 34 and a plurality of turbines shown generally at 36. The valve 22 is illustrated diagrammatically which is connected to a model based predictive controller (MBPC) 38. The controller 38 sends a signal 40 as required to control the valve 22.

A sensor (not shown) is provided to measure the temperature of the turbine gases exiting the low pressure turbine, and this produces a signal 42. The signal 42 is supplied to a dynamic thermodynamic model 44 of the turbine blade expansion and contraction, and also a dynamic thermodynamic model 46 of the turbine case expansion and contraction. These models 44, 46 provide a signal 50 to the controller 38. An input 48 of the required gap 30 for the engine 32 is provided to the controller 38 during construction or set up.

In operation, in response to the signal 42 which provides an indication of the running state of the engine 32, the models 44, 46 predict the present and future expansion of the blades 28 and inner skin 14 and provide a signal 50 to the controller 38. The controller 38 provides appropriate signals 40 to control the valve 22 over time to maintain as constant a required gap 30 as possible, whilst also taking into effect the future differential expansions over time of the blades 28 and inner skin 14. In general the skin 14 will expand at a significantly quicker rate than the blades 28, and hence cooling will be provided by forcing cool air into the cooling space 18 to arrange for the expansion of the inner skin 14 to substantially mimic the expansion of the blades 28 and hence maintain the required gap 30.

A further explanation of the arrangement will now be described with reference to FIG. 3, which is a graph with time on the X axis, and the gap 30 on the Y axis. A reference trajectory 52 is provided for the gap 30 and the predicted gap is shown by dots. The control for the valve 22 is shown by the solid line.

Figure 3:
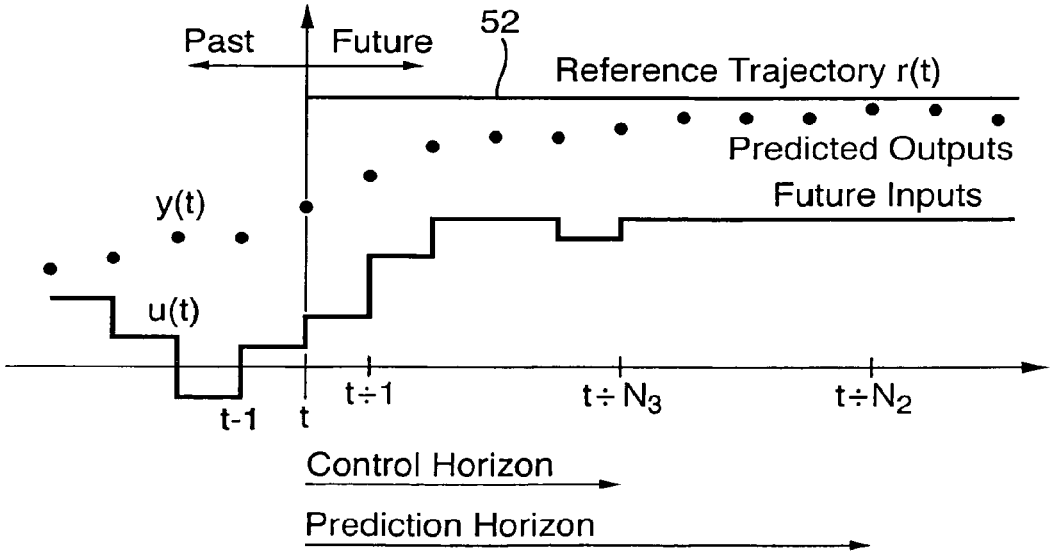
FIG. 3 is a graph schematically illustrating operation of the arrangement of FIG. 2.

As shown in FIG. 3 when t=0 this is the present time with the past to the left and the future to the right of the Y axis. In practice a model is produced to describe the expansion and contraction of the inner skin 14 and blades 28, and the model can be tested to verify its accuracy. From this model the future behaviour of the system is predicted over a finite time interval, usually called the prediction horizon, starting at the current time t. These predictions are functions of the current state of the system and the future input variables $\hat{u}(t+k|k)$, where $k=0, 1, \ldots, N_3-1$. $N_3$ is used to denote the end of the control horizon. Finally the optimal control sequence of these input variables are chosen and the first input in this sequence ($\hat{u}(t|t)$) is applied to the system under control. At the next time instant t+1, this process is repeated all over again with the prediction horizon shifted one time step ahead.

The predictive control algorithm can be summarised in the following steps.

1. At time t predict the output from the system, $\hat{y}(t+k|k)$, where $k=N_1, N_1+1, \ldots, N_2$ These outputs will depend on the measured system states at time t and on the future control signals, $\hat{u}(t+j|t)$, $j=0, 1, \ldots, N_3$.

2. Then an optimisation criterion is selected to optimise these variables with respect to $\hat{u}(t+j|t)$, $j=0, 1, \ldots, N_3$.
3. Apply $u(t)=\hat{u}(t|t)$.
4. At the next time instance go to step 1 and repeat.

The optimisation criterion mentioned in step 2 above can take various forms, but by far most commonly used is the quadratic criterion of some type. Using the standard formulation without constraints, a closed form solution can be attained. The following is a typical quadratic cost function.

$$J(t) = \sum_{k=N_1}^{N_2} \|y(t+k\,|\,t) - r(t+k\,|\,t)\|^2_{Q_{1(k)}} + \sum_{k=0}^{N_3-1} \|\Delta\hat{u}(t+k\,|\,t)\|^2_{Q_{2(k)}}$$

This cost function penalises differences between the predicted outputs $\hat{y}(t+k|k)$ and the reference trajectory $r(t+k|t)$ over the prediction horizon, which starts at $t+N_2$. It also penalises changes in the control signal a $\Delta\hat{u}(t+k|t)$ over the control horizon, which spans from t to $t+N_3$ It is generally assumed that $N_3 \leqq N_2$ and that $\Delta\hat{u}(t+k|t)=0$ for $k \geqq N_3$.

There is thus described a method and also an arrangement for providing improved turbine case cooling and thus increasing engine efficiency. The arrangement does not require significant additional apparatus, and monitors the running state of the engine by measuring turbine gas temperature, which approved and robust sensor measurement. The predictive control architecture used allows the arrangement to know where the system will be in a defined number of timed sequences into the future based on the current measurement. This enables future changes to be taken into account to provide appropriate cooling to maintain a required gap. There is no requirement for further sensors to be added to the engine, thereby preventing additional cost and potential errors during running.

Various modifications may be made without departing from the scope of the invention. For instance, the running state of the engine may be differently measured and could be carried out by measuring gas temperature elsewhere in the engine. Alternative possible measurements are the fuel flow in the engine, the spool speed, or the air pressure being delivered to the combustor. It may be that different methods of cooling the turbine casing could be used.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method of controlling turbine case cooling in a gas turbine engine, the method comprising: monitoring a present running state of the engine; estimating with a thermal expansion model expected thermal expansion of the turbine case and turbine blades; and controlling cooling of the turbine case in response to said expected thermal expansion to provide a required gap between the turbine case and the turbine blades over time;

wherein each estimation of expected thermal expansion includes estimating multiple consecutive expected thermal expansion values of the turbine case and turbine blades over a finite period of time.

2. A method according to claim 1, wherein the thermal expansion model includes turbine case and turbine blade expansion rates.

3. A method according to claims 1, wherein the engine monitoring is carried out by measuring the turbine gas temperature.

4. A method according to claim 3, wherein the engine monitoring is carried out by measuring the turbine exit gas temperature.

5. A method according to claim 1, wherein monitoring the present running state of the engine includes any of: measuring the gas temperature in the engine other than in the turbine; measuring fuel flow in the engine; measuring engine spool speed; and measuring air pressure being delivered to a combustor of the engine.

6. A method according to claim 1, wherein the cooling of the turbine case is provided by supplying cool air between the inner and outer skins of the turbine case.

7. A method according to claim 6, wherein the amount of air supplied is variable.

8. A method according to claim 1, wherein the method is performed by a model based predictive controller.

* * * * *